US009795261B2

(12) United States Patent
Krebs

(10) Patent No.: US 9,795,261 B2
(45) Date of Patent: Oct. 24, 2017

(54) VACUUM CLEANER

(71) Applicant: BISSELL Homecare, Inc., Grand Rapids, MI (US)

(72) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 351 days.

(21) Appl. No.: 14/613,846

(22) Filed: Feb. 4, 2015

(65) Prior Publication Data

US 2015/0223650 A1 Aug. 13, 2015

Related U.S. Application Data

(60) Provisional application No. 61/937,826, filed on Feb. 10, 2014.

(51) Int. Cl.
*A47L 5/22* (2006.01)

(52) U.S. Cl.
CPC ..... *A47L 5/225* (2013.01)

(58) Field of Classification Search
CPC ..... A47L 9/1683; A47L 9/1608; A47L 9/165; A47L 9/1691; A47L 5/24; A47L 5/225; A47L 9/242; A47L 9/106; A47L 11/22
See application file for complete search history.

(56) References Cited

U.S. PATENT DOCUMENTS

| | | | | |
|---|---|---|---|---|
| 1,268,988 | A | 6/1918 | Mason | |
| 2,949,624 | A | 8/1960 | Lampe | |
| 4,393,536 | A | 7/1983 | Tapp | |
| 4,563,790 | A | 1/1986 | Clark | |
| 4,660,246 | A | 4/1987 | Duncan et al. | |
| 5,355,549 | A | 10/1994 | Steinberg et al. | |
| 6,168,641 | B1 | 1/2001 | Tuvin et al. | |
| 7,051,401 | B2 * | 5/2006 | Park | A47L 9/02 15/328 |
| 7,356,874 | B2 | 4/2008 | Skinner Macleod et al. | |
| 7,578,025 | B2 | 8/2009 | Kostreba et al. | |
| 7,676,883 | B2 * | 3/2010 | Macleod | A47L 5/32 15/334 |
| 8,789,234 | B2 * | 7/2014 | Lee | A47L 5/225 15/328 |
| 2006/0248680 | A1 | 11/2006 | Heidenga et al. | |
| 2008/0263813 | A1 | 10/2008 | Han et al. | |

(Continued)

FOREIGN PATENT DOCUMENTS

| | | | |
|---|---|---|---|
| DE | 102012112532 | A1 | 6/2014 |
| GB | 2342282 | A | 4/2000 |
| GB | 2461606 | A | 1/2010 |

(Continued)

OTHER PUBLICATIONS

Evelyn Toalster, Examination Report Under Section 18(3), Apr. 11, 2016, 6 pages, South Wales.

(Continued)

*Primary Examiner* — Robert Scruggs
(74) *Attorney, Agent, or Firm* — McGarry Bair PC

(57) ABSTRACT

A vacuum cleaner for cleaning a surface is convertible between an upright mode and a canister mode. The vacuum cleaner includes a diverter assembly to selectively divert a working air flow through different working air flow paths which correspond to the upright mode and the canister mode.

24 Claims, 8 Drawing Sheets

(56) References Cited

U.S. PATENT DOCUMENTS

| | | | | |
|---|---|---|---|---|
| 2011/0173771 | A1 | 7/2011 | Park et al. | |
| 2014/0237755 | A1* | 8/2014 | Conrad | A47L 5/225 15/329 |

FOREIGN PATENT DOCUMENTS

| | | | |
|---|---|---|---|
| GB | 2461657 | A | 1/2010 |
| GB | 2462124 | A | 1/2010 |
| GB | 2469363 | A | 10/2010 |
| GB | 2474477 | A | 4/2011 |
| GB | 2487300 | A | 7/2012 |

OTHER PUBLICATIONS

Intellectual Property Office, Search Report Under Section 17(5), Jun. 25, 2015, 4 pages, South Wales, United Kingdom.

* cited by examiner

VACUUM CLEANER

CROSS REFERENCE TO RELATED APPLICATION(S)

This application claims the benefit of U.S. Provisional Patent Application No. 61/937,826, filed Feb. 10, 2014, which is incorporated herein by reference in its entirety.

BACKGROUND

Surface cleaning apparatuses, such as vacuum cleaners, are provided with a vacuum collection system for creating a partial vacuum to suck up debris (which may include dirt, dust, soil, hair, and other debris) from a surface to be cleaned and collecting the removed debris in a space provided on the vacuum cleaner for later disposal. Vacuum cleaners are usable on a wide variety of common household surfaces such as soft flooring including carpets and rugs, and hard or bare flooring, including tile, hardwood, laminate, vinyl, and linoleum.

Vacuum cleaners for typical household use can be configured as an upright unit having a base for movement across a surface to be cleaned and an upright body pivotally mounted to a rearward portion of the base for directing the base across the surface to be cleaned, a canister unit having a cleaning implement connected to a wheeled base by a suction hose, or a portable unit adapted to be hand carried by a user for cleaning relatively small areas.

BRIEF SUMMARY

The invention relates to a vacuum cleaner convertible between an upright mode and a canister mode.

According to one aspect of the invention, the vacuum cleaner includes a canister unit adapted to be moved across a surface to be cleaned, at least one suction inlet, a separating and collection assembly for separating and collecting debris, a suction source in fluid communication with the at least one suction inlet and the separating and collection assembly for generating a working air stream from the at least one suction inlet to the separating and collection assembly, a conduit defining a working air path and comprising a hose and a wand, wherein the wand is attached to, and forms at least a portion of a handle for, the canister unit in the upright mode and wherein the wand is detached from the canister unit in the canister mode, and a diverter assembly operably coupled with the conduit, wherein a portion of the conduit is rotatable to move the diverter assembly between an upright configuration in which the working air path of the conduit is closed and a canister configuration in which the working air path of the conduit is open.

According to another aspect of the invention, the vacuum cleaner includes a canister unit adapted to be moved across a surface to be cleaned and having a separating and collection assembly for separating and collecting debris and a first suction inlet, a conduit comprising a wand detachably mounted to the canister to form a handle for the canister in the upright mode and a second suction inlet, a suction source carried by the canister unit, and a diverter assembly operable between a first position, where the first suction inlet is in fluid communication with the suction source in the upright mode, and a second position, where the second suction inlet is in fluid communication with the suction source in the canister mode, wherein in the upright mode the wand is mounted to and forms a handle for the canister and the diverter assembly is in the first position, and in the canister mode the wand is detached from the canister unit and the diverter assembly is in the second position, and the conduit is fluidly coupled to the diverter assembly in both the upright and canister modes.

BRIEF DESCRIPTION OF THE DRAWING(S)

DETAILED DESCRIPTION OF THE INVENTION

Figure 1:
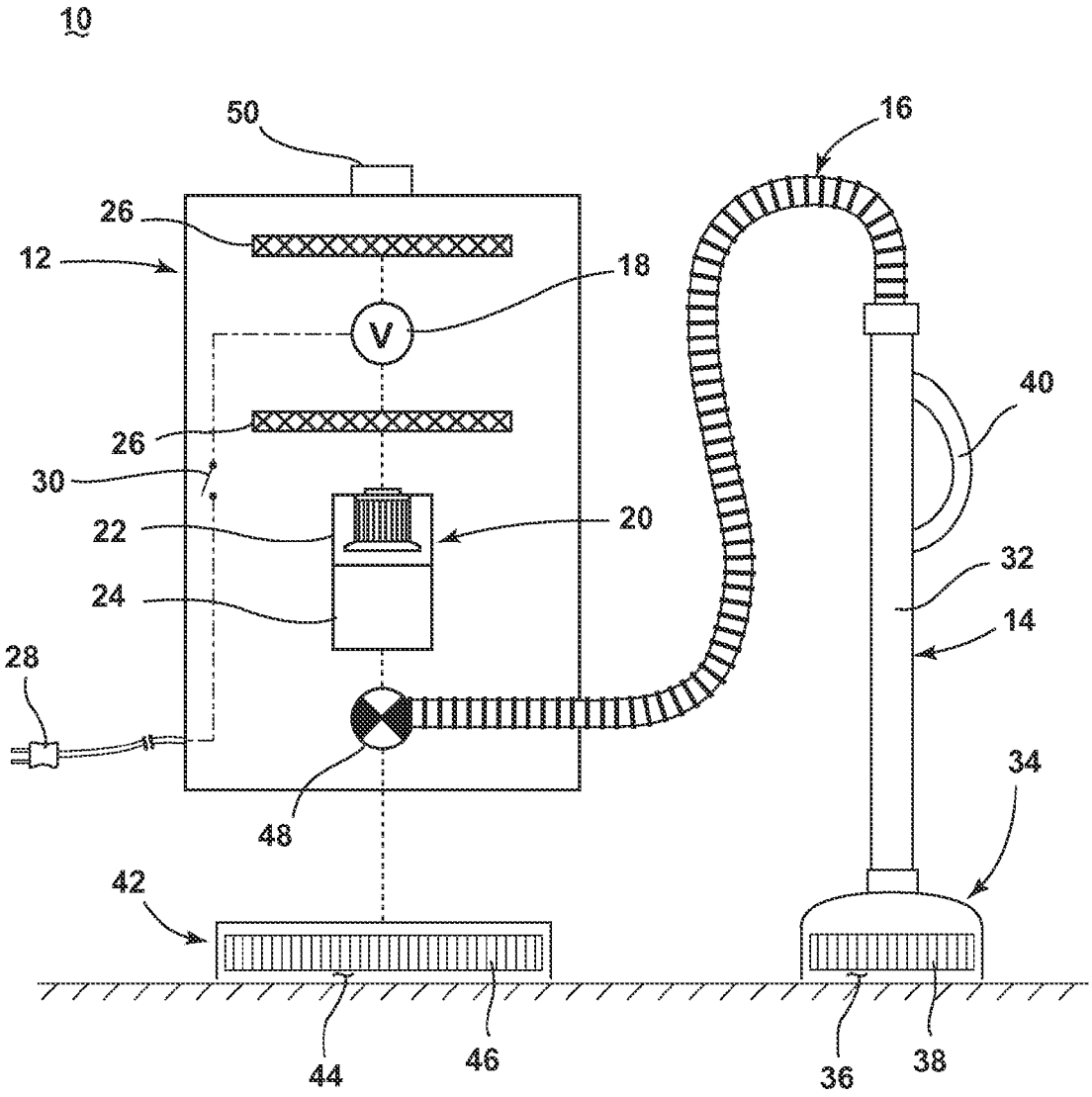
FIG. 1 is a schematic view of a vacuum cleaner according to a first embodiment of the invention, with the vacuum cleaner in a canister configuration.

FIG. 1 is a schematic view of various functional systems of a surface cleaning apparatus in the form of a vacuum cleaner 10. The vacuum cleaner 10 may be substantially similar to a conventional canister vacuum cleaner in that it includes a canister unit 12 coupled to a wand 14 by a vacuum hose 16. The canister unit 12 can include a vacuum collection system for creating a partial vacuum to suck up debris (which may include dirt, dust, soil, hair, and other debris) from a surface to be cleaned using the wand and collecting the removed debris in a space provided on the vacuum cleaner 10 for later disposal. However, the vacuum cleaner 10 differs from conventional canister vacuum cleaners in that the vacuum cleaner 10 is convertible from the canister configuration shown in FIG. 1 to an upright configuration shown in FIG. 2, and vice versa.

Referring to the canister configuration shown in FIG. 1, the canister unit 12 can have a suction source 18 in fluid communication with the vacuum hose 16 for generating a working air stream, and a separating and collection assembly 20 for separating and collecting liquid and debris from the working airstream for later disposal. The canister unit 12 can be provided with wheels, casters, or other features for maneuvering the canister unit 12 over a floor surface.

In one configuration illustrated herein, the collection assembly 20 can include a cyclone separator 22 for separating contaminants from a working airstream and a removable debris cup 24 for receiving and collecting the separated contaminants from the cyclone separator 22. The cyclone separator 22 can have a single cyclonic separation stage, or multiple stages. In another configuration, the collection assembly 20 can include an integrally formed cyclone separator and debris cup, with the debris cup being provided with a structure, such as a bottom-opening debris door, for contaminant disposal. It is understood that other types of collection assemblies 20 can be used, such as a centrifugal separator, a bulk separator, a filter bag, or a water-bath separator. The canister unit 12 can also be provided with one or more additional filters 26 upstream or downstream of the separating and collection assembly 20 or the suction source 18.

The suction source 18, such as a motor/fan assembly, is provided in fluid communication with the separating and collection assembly 20, and can be positioned downstream or upstream of the separating and collection assembly 20. The suction source 18 can be electrically coupled to a power source 28, such as a battery or by a power cord plugged into a household electrical outlet. A suction power switch 30 between the suction source 18 and the power source 28 can be selectively closed by the user upon pressing a vacuum power button (not shown), thereby activating the suction source 18. As shown herein, the suction source 18 is downstream of the separating and collection assembly 20 for a 'clean air' system; alternatively, the suction source 18 can be upstream of the separation and collection assembly 20 for a 'dirty air' system.

The wand 14 includes an elongated hollow tube 32 having a distal end and proximal end that is coupled with the vacuum hose 16, which can be a flexible and/or corrugated conduit. A suction tool 34 can be provided on the distal end of the wand for engaging and cleaning a surface, such as, but not limited to a floor surface, furniture, curtains, etc. Multiple different suction tools 34 adapted for different cleaning operations can be provided, and can be interchangeably mounted to the wand 14. Some non-limiting examples include a floor cleaning tool, an upholstery cleaning tool, and a crevice tool. The suction tool 34 shown herein includes a suction inlet 36 in fluid communication with the separating and collection assembly 20 via the hollow tube 32 of the wand 14 and the hose 16. Optionally, an agitator 38 can be provided adjacent to the suction inlet 36 for agitating debris on the surface to be cleaned so that the debris is more easily ingested into the suction inlet 36. Some examples of agitators 38 include, but are not limited to, a rotatable brushroll, dual rotating brushrolls, or a stationary brush. A hand grip 40 can be provided near the proximal end of the wand 14 to facilitate moving the wand 14 over the surface to be cleaned.

A floor suction nozzle 42 can be provided on the canister unit 12 for use in the upright configuration and is in fluid communication with the suction source 18 in the upright configuration for engaging and cleaning a floor surface. The floor suction nozzle 42 includes a suction inlet 44 in fluid communication with the separating and collection assembly 20. Optionally, an agitator 46 can be provided adjacent to the suction inlet 44 for agitating debris on the surface to be cleaned so that the debris is more easily ingested into the suction inlet 44. Some examples of agitators 46 include, but are not limited to, a rotatable brushroll, dual rotating brushrolls, or a stationary brush.

Figure 2:
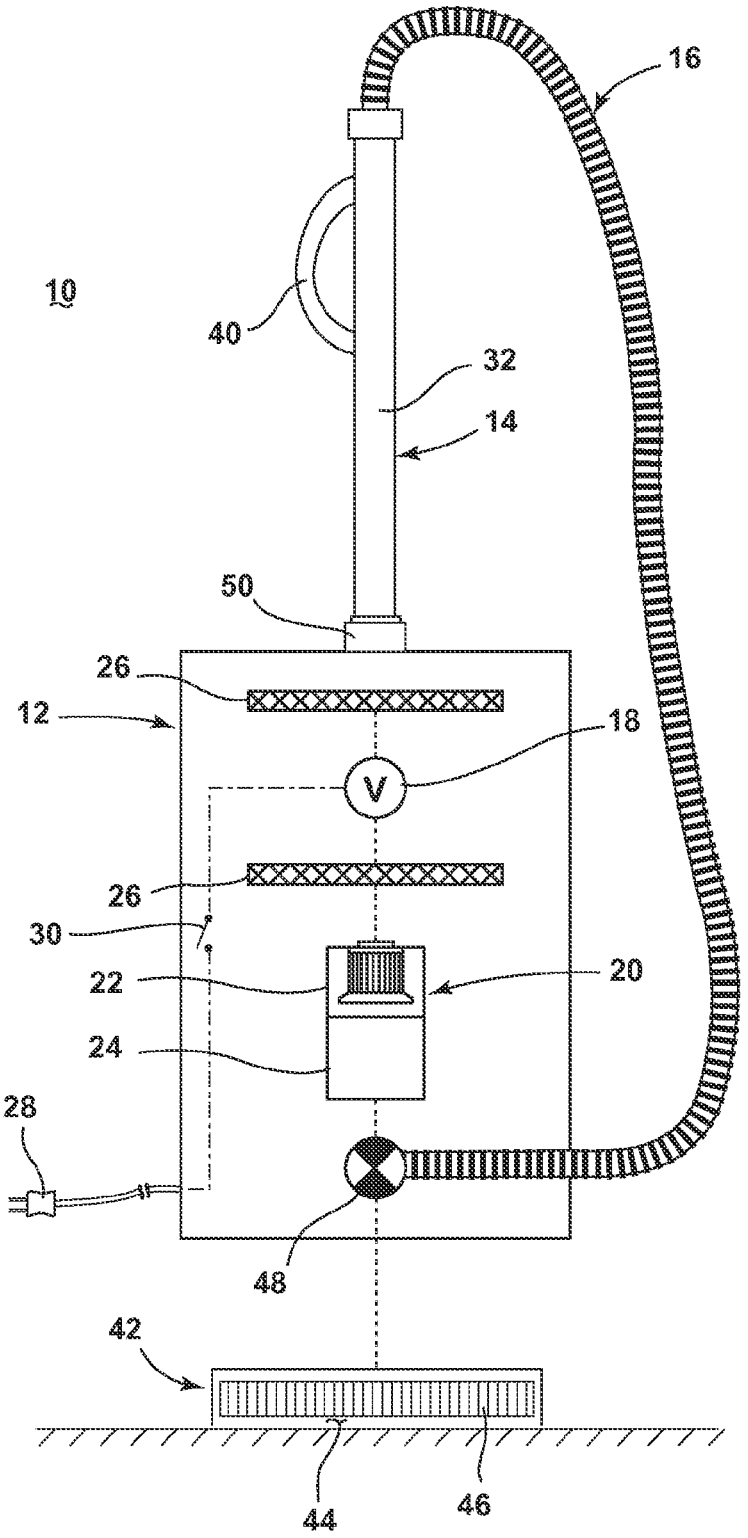
FIG. 2 is a schematic view of the vacuum cleaner from FIG. 1 in an upright configuration.

A diverter assembly 48 is provided in the working air flow path through the vacuum cleaner 10 for selectively diverting the working air flow between the vacuum hose 16 in the canister configuration (FIG. 1) and the floor suction nozzle 42 in the upright configuration (FIG. 2). The diverter assembly 48 can be provided in an air pathway leading to an inlet of the separating and collection assembly 20, and can be moved by the user between a first position, shown in FIG. 1, in which the vacuum hose 16 is in fluid communication with the suction source 18 to deliver debris to the separating and collection assembly 20, and a second position shown in FIG. 2, in which the floor suction nozzle 42 is in fluid communication with the suction source 18 to deliver debris to the separating and collection assembly 20.

Optionally, instead of providing both a suction tool 34 for the wand 14 and the floor suction nozzle 42 on the canister unit 12, the floor suction nozzle 42 can be eliminated and the suction tool 34 can be selectively mounted to the canister unit 12 for upright cleaning when the vacuum cleaner 10 is converted to the upright configuration shown in FIG. 2. Alternatively, the suction tool 34 can be eliminated and the suction nozzle 42 can be configured for interchangeable mounting to either of the wand 14 for use in the canister configuration (FIG. 1) and the canister unit 12 for use in the upright configuration (FIG. 2).

A wand coupler 50 is provided on the canister unit 12 for attachment of the wand 14 to the canister unit 12 in the upright configuration, shown in FIG. 2. In the upright configuration, the canister unit 12 acts as the base and the wand 14 acts as a handle for the base. The wand coupler 50 receives the distal end of the wand 14, after it has been separated from the suction tool 34. The wand coupler 50 may be fixed with respect to the canister unit 12, or may pivot to allow the wand 14 to rotate relative to the canister unit 12 in the upright configuration.

In the upright configuration, the vacuum cleaner 10 can more specifically have a "stick" configuration in which the majority of the components of the vacuum system are provided on the base or canister unit 12, and the upright body is primarily made up of the handle or wand 14. As shown, the base includes the suction source 18, the separating and collection assembly 20, the optional filter 26, and the floor suction nozzle 42, while the upright body includes only the wand 14, with the vacuum hose 16 remaining connected between the wand 14 and the canister unit 12. The vacuum hose 16 may be removed from the vacuum cleaner 10, or may remain physically connected between the canister unit 12 and the wand 14; however, no air flows through the wand 14 or vacuum hose 16.

The vacuum cleaner 10 shown in FIG. 1-2 can be used to effectively clean a surface by removing debris (which may include dirt, dust, soil, hair, and other debris) from the surface in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform vacuum cleaning in the canister configuration shown in FIG. 1, the suction source 18 is coupled to the power source 28 and the diverter assembly 48 is moved to the first position. In the canister configuration, the wand 14 is fluidly and physically coupled to the canister unit 12 by the vacuum hose 16, such that fluid enters the wand 14 first and passes through the vacuum hose 16 prior to entering the canister unit 12. Specifically, the suction source 18 draws in debris-laden air sequentially through the suction tool 34, wand 14 and vacuum hose 16, and into the separating and collection assembly 20 where the debris is substantially separated from the working air. The air flow then passes the suction source 18, and through any optional filters 26 positioned upstream and/or downstream from the suction source 18, prior to being exhausted from the vacuum cleaner 10. During canister vacuum cleaning, the agitator 38 can agitate debris on the surface to be cleaned so that the debris is more easily ingested into the suction inlet 36. The separating and collection assembly 20 can be periodically emptied of collected debris. Likewise, the optional filters 26 can periodically be cleaned or replaced.

To perform vacuum cleaning in the upright configuration shown in FIG. 2, the vacuum cleaner 10 is converted from the canister configuration to the upright configuration. The distal end of the wand 14 is removed from the suction tool 34 and attached to the wand coupler 50 on the canister unit 12, and the diverter assembly 48 is moved to the second position. The suction source 18 draws in debris-laden air through the floor suction nozzle 42 and into the separating and collection assembly 20 where the debris is substantially separated from the working air. The air flow then passes the suction source 18, and through any optional filters 26 positioned upstream and/or downstream from the suction source 18, prior to being exhausted from the vacuum cleaner 10. During upright vacuum cleaning, the agitator 46 can agitate debris on the surface to be cleaned so that the debris is more easily ingested into the suction inlet 44. The separating and collection assembly 20 can be periodically emptied of debris. Likewise, the optional filters 26 can periodically be cleaned or replaced.

Figure 3:
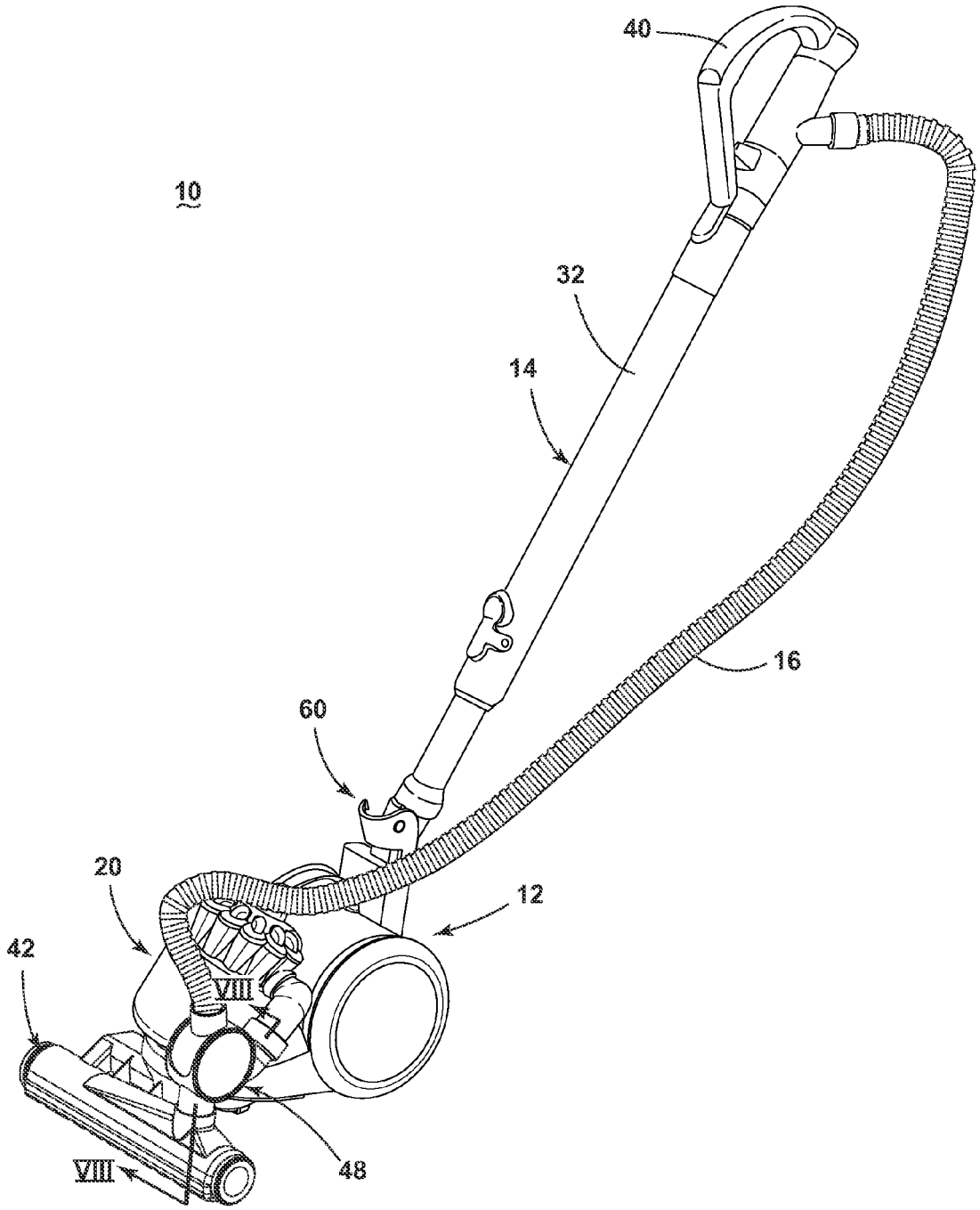
FIG. 3 is a perspective view of a vacuum cleaner according to a second embodiment of the invention, with the vacuum cleaner in an upright configuration.
Figure 4:
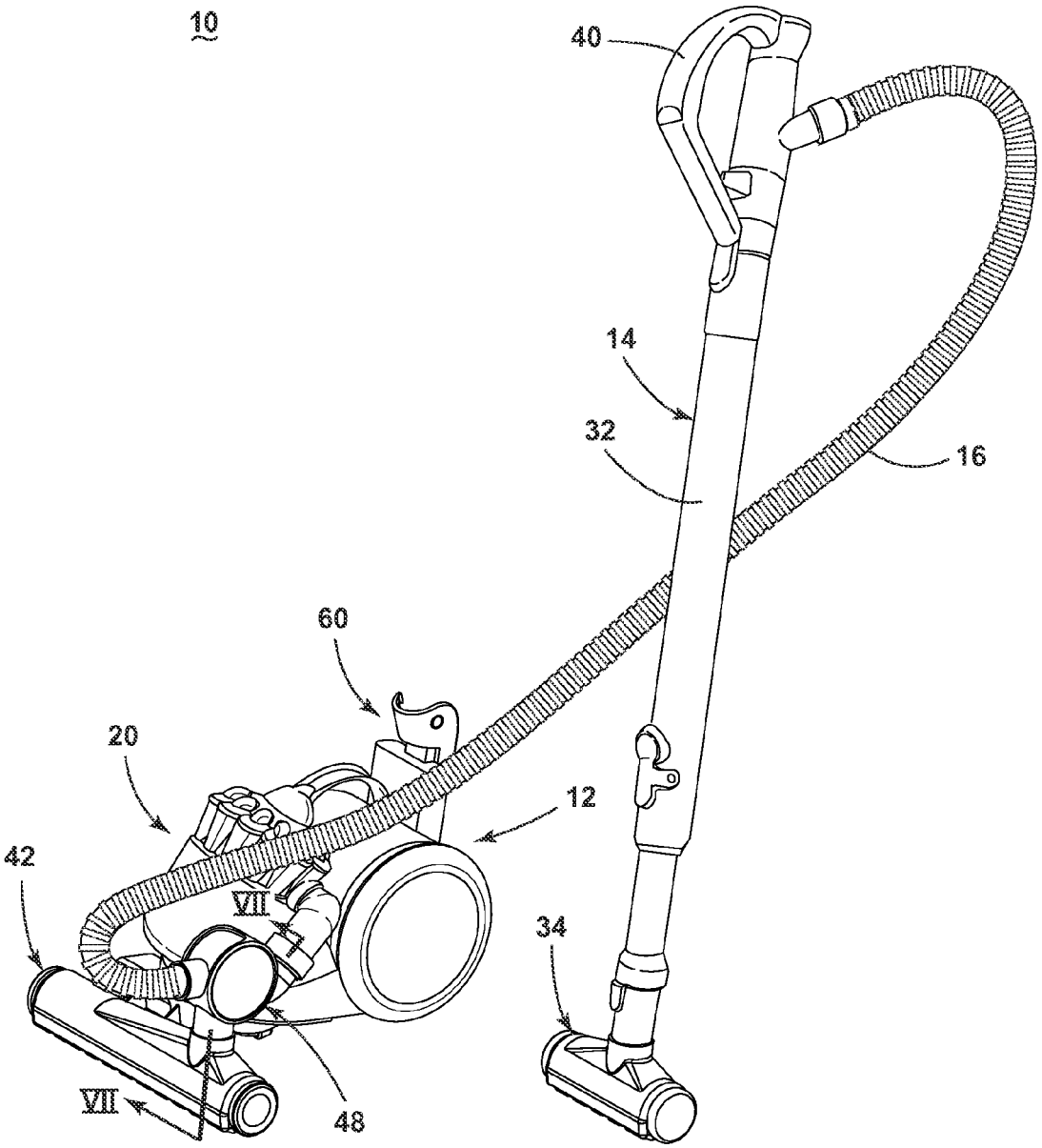
FIG. 4 is a perspective view of the vacuum cleaner from FIG. 3 in a canister configuration.

FIGS. 3-4 show one example of the vacuum cleaner 10 schematically illustrated in FIGS. 1-2, according to a second embodiment of the invention. In the second embodiment, like elements are identified with the same reference numerals. Like the first embodiment, the second embodiment of the vacuum cleaner 10 is convertible between an upright configuration shown in FIG. 3 and a canister configuration shown in FIG. 4.

For purposes of description related to the figures, the terms "upper," "lower," "right," "left," "rear," "front," "vertical," "horizontal," "inner," "outer," and derivatives thereof shall relate to the invention as oriented in FIG. 3 from the perspective of a user behind the vacuum cleaner 10 in the upright configuration, which defines the rear of the vacuum cleaner 10. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
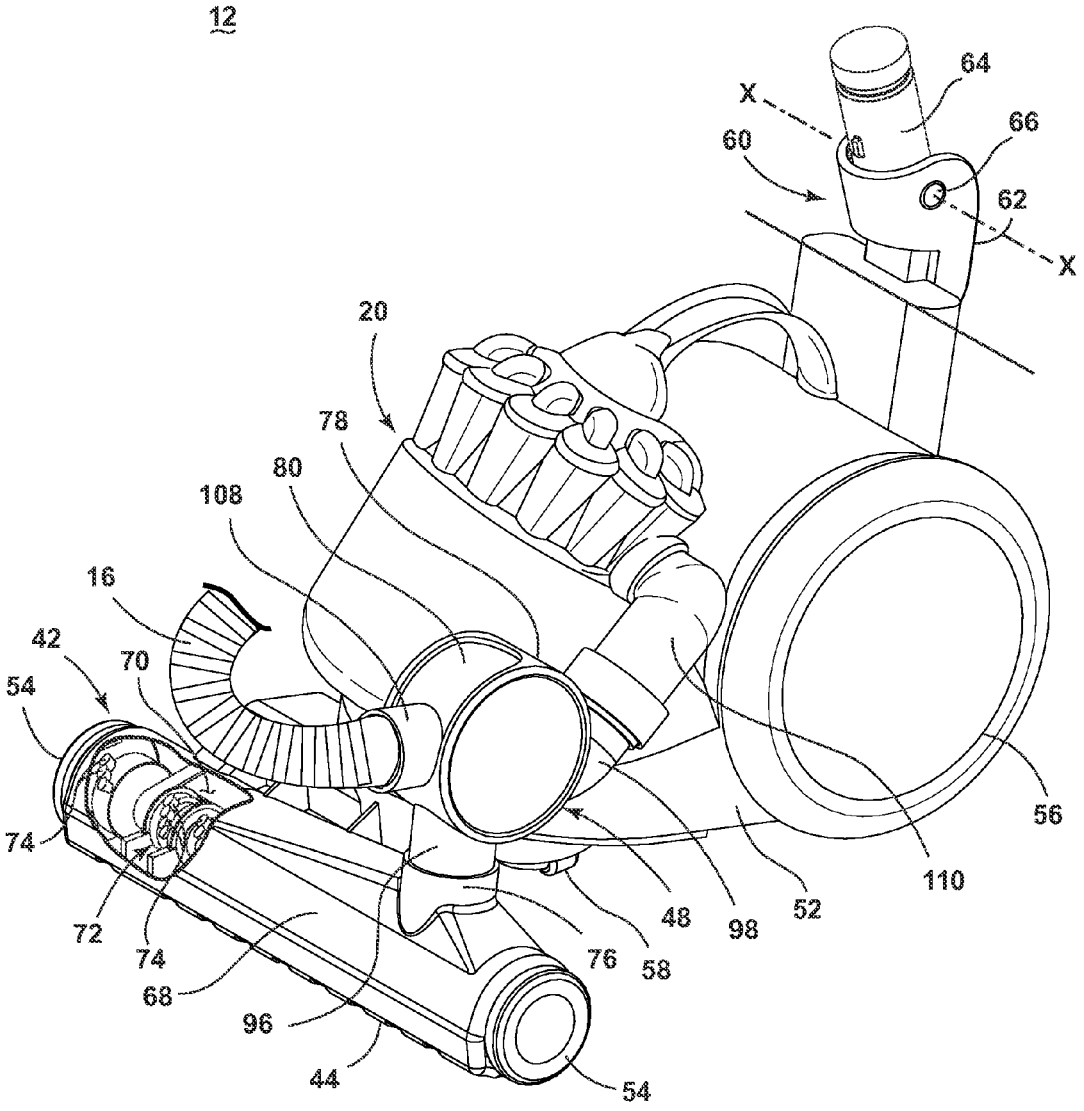
FIG. 5 is a close-up view of the vacuum cleaner from FIG. 4 in the canister configuration, with the hose partially removed for clarity.

FIG. 5 is a close-up view of the canister unit 12 from FIG. 4, with the vacuum hose 16 partially removed for clarity. The canister unit 12 of the vacuum cleaner 10 includes a housing 52 which is adapted to be moved across a surface to be cleaned. The housing 52 may support one or more components of the vacuum system discussed with respect to FIGS. 1-2. The housing 52 can be provided with wheels, casters, or other features for maneuvering the canister unit 12 over a floor surface. As shown herein, a pair of front wheels 54 are provided on a front portion of the housing 52, a pair of rear wheels 56 are provided on a rear portion of the housing 52, and a caster 58 is provided on the underside of the housing 52, in between the front and rear wheels 54, 56.

A coupling joint 60 is formed at a rear side of the housing 52 and moveably mounts the canister unit 12 to the wand 14. In the embodiment shown herein, the coupling joint 60 can include a lower bracket 62 attached to the housing 52 and an upper wand coupler 64 pivotally attached to the lower bracket 62 by an axle 66, which defines a rotational axis X of the coupling joint 60. The wand coupler 64 can receive the distal end of the wand 14 in the upright configuration. In another configuration, the coupling joint 60 can be a universal joint, such that the wand 14 can pivot about at least two axes relative to the canister unit 12.

The floor suction nozzle 42 of the second embodiment includes a nozzle cover 68 defining an agitator chamber 70. The front wheels 54 can be provided at opposite ends of the nozzle cover 68. The agitator 46, illustrated in the form of a rotatable brushroll 72, is positioned within the agitator chamber 70, adjacent the suction inlet 44, for agitating the surface to be cleaned. The brushroll 72 can be coupled to and driven by a dedicated brush motor (not shown) provided in the canister unit 12 via a commonly known arrangement. Alternatively, the brushroll 72 can be coupled to a motor/fan assembly defining the suction source 18 (FIG. 1) The agitator 46 is illustrated as a single rotatable brushroll 72 having multiple bristles 74 for agitating the surface the cleaned; however, it is within the scope of the invention for other types of agitators 46 to be used, such as dual rotating brushrolls, vertical axis brushes, or brushrolls having agitating elements other than bristles, for example.

The suction inlet 44 is formed at the underside of the nozzle cover 68, and is in fluid communication with the agitator chamber 70. A nozzle coupler 76 is coupled at one end to the agitator chamber 70 and fluidly communicates the suction inlet 44 with the diverter assembly 48 to form a portion of the working air path between the floor suction nozzle 42 and the collection assembly 20 when the vacuum cleaner 10 is in the upright configuration.

Figure 6:
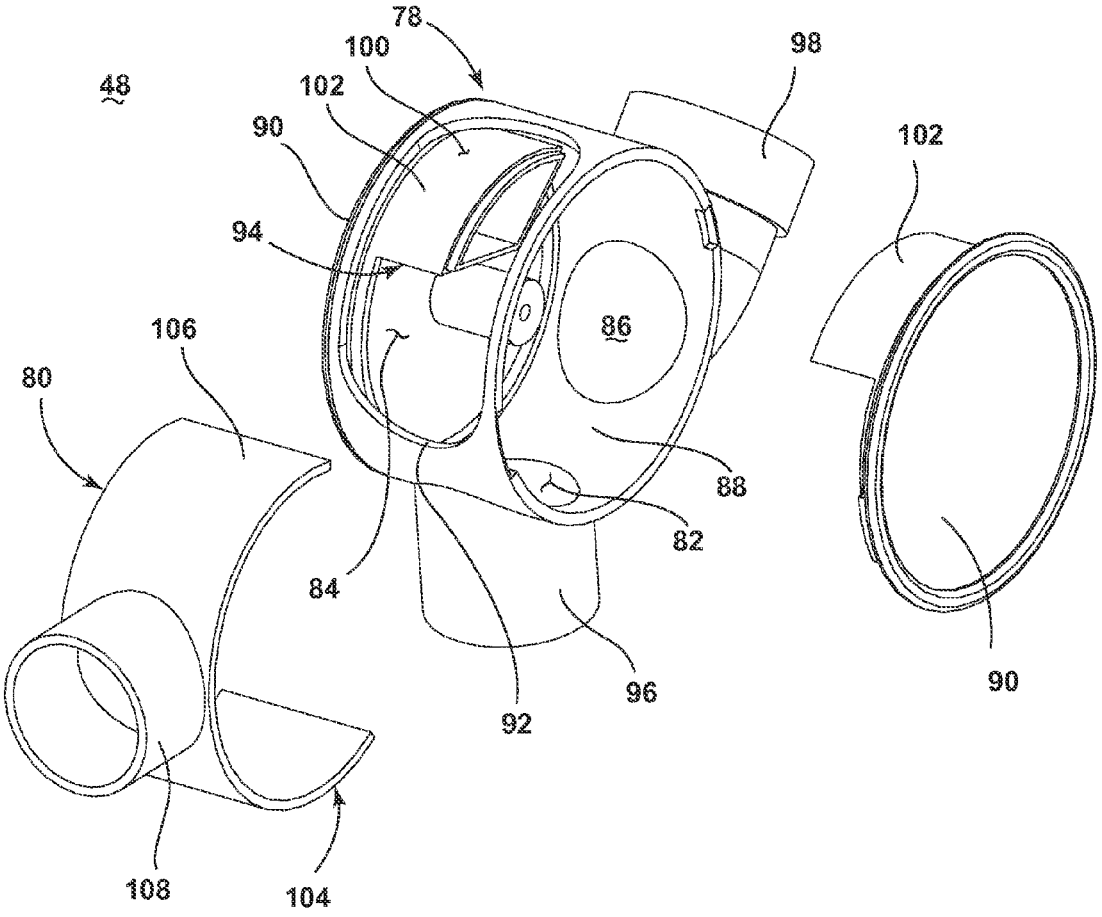
FIG. 6 is a partially exploded view of a diverter assembly for the vacuum cleaner from FIG. 3.

FIG. 6 is a partially exploded view of the diverter assembly 48 from FIG. 3. The diverter assembly 48 of the second embodiment includes a three-port valve assembly including a valve housing 78 which receives a valve 80. The valve housing 78 defines a floor inlet port 82 in fluid communication with the floor suction nozzle 42, a hose inlet port 84 in fluid communication with the vacuum hose 16, and an outlet port 86 in fluid communication with the separating and collection assembly 20. Movement of the valve 80 within the valve housing 78 selectively places the floor inlet port 82 or the hose inlet port 84 in fluid communication with the outlet port 86.

The valve housing 78 includes a cylindrical peripheral wall 88 and two end walls 90. The peripheral wall 88 can define open ends of the valve housing 78, with the end walls 90 provided as covers for closing the open ends. An elongated slot 92 is formed in the peripheral wall 88. A shield 94 blocks a portion of the slot 92, with the open or unblocked portion of the slot 92 defining the hose inlet port 84. The floor inlet port 82 and the outlet port 86 can be defined by ducts 96, 98, respectively, which are fixed on the peripheral wall 88.

The shield 94 is radially spaced inwardly from the peripheral wall 88 to define a guide track 100 which receives a portion of the valve 80. At least one of the end walls 90 can carry the shield 94. As illustrated, each end wall 90 can include a semi-cylindrical wall 102, which extend toward each other and meet to define the shield 94. The shield 94 can alternatively be provided on another portion of the valve housing 78.

The valve 80 comprises a rotary valve body 104 that is rotatably supported by the valve housing 78 for rotational movement to connect either of the inlet ports 82, 84 as desired to the outlet port 86. As shown the rotary valve body 104 can be provided in the form of a curved plate 106 that is retained between the peripheral wall 88 and the shield 94, and slides in the guide track 100. A hose duct 108 is provided on the valve body 104 and projects through the slot 92 in the peripheral wall 88 of the valve housing 78. Due to the cylindrical shape of the valve body 104 and the guide track 100 in the embodiment shown herein, the sliding movement of the valve body 104 within the guide track 100 translates to pivoting movement of the hose duct 108.

Figure 7:
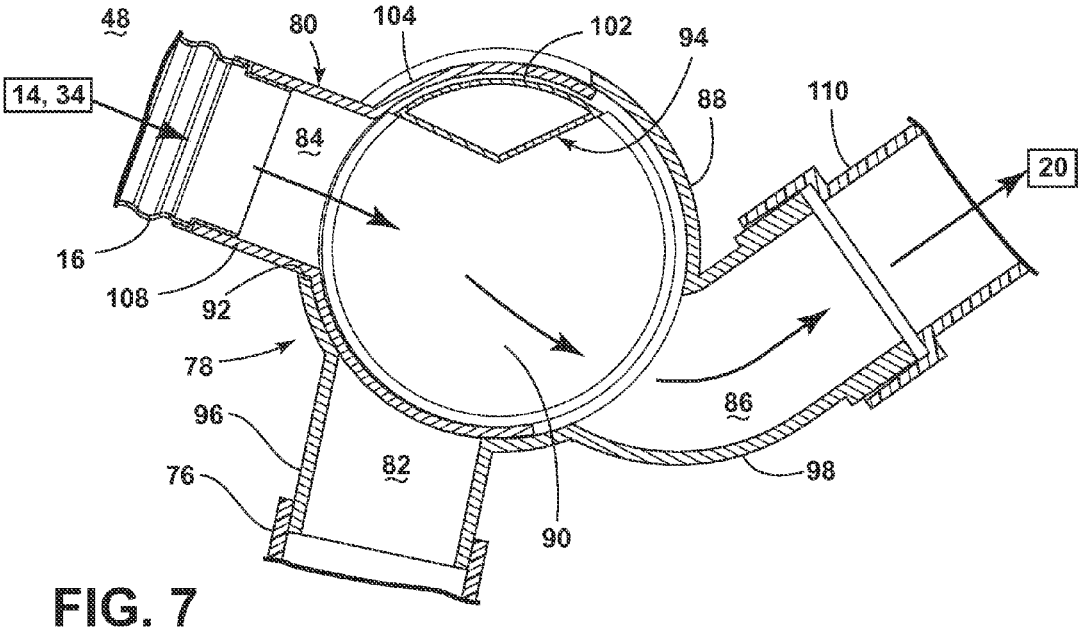
FIG. 7 is a cross-sectional view of the diverter assembly in the canister configuration, taken through line VII-VII of FIG. 4.
Figure 8:
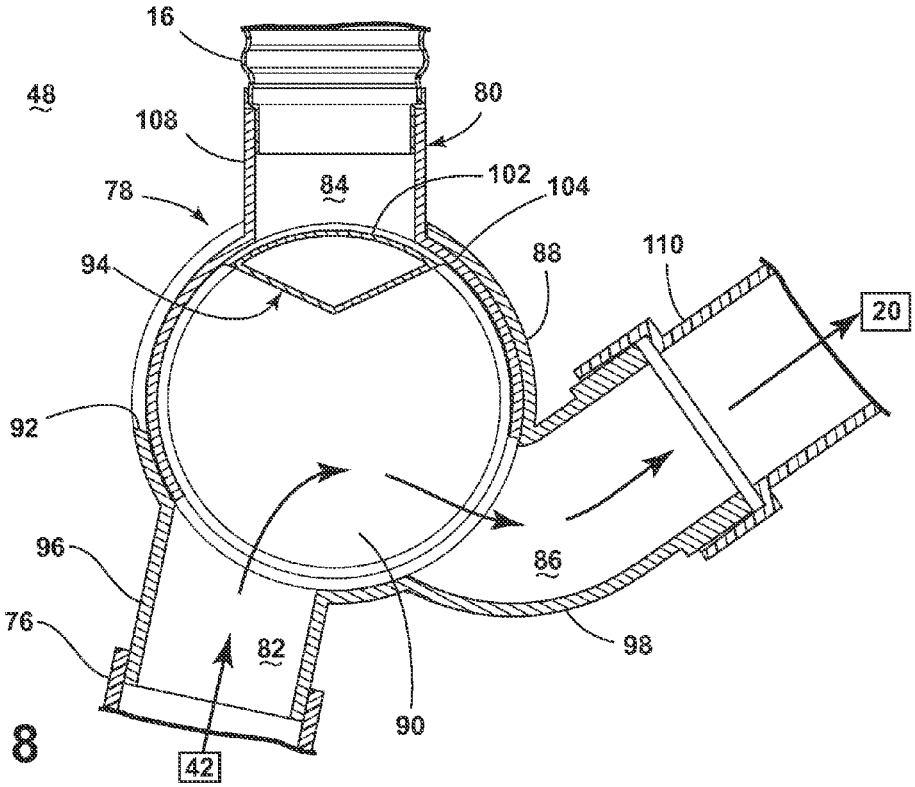
FIG. 8 is a cross-sectional view of the diverter assembly in the upright configuration, taken through line VIII-VIII of FIG. 3.

FIGS. 7 and 8 are cross-sectional views of the diverter assembly 48 taken through line VII-VII of FIG. 4 and line VIII-VIII of FIG. 3, respectively, showing the diverter assembly 48 in the canister configuration and the upright configuration, respectively. The hose duct 108 is coupled with the end of the vacuum hose 16 opposite the wand 14 and fluidly communicates the wand 14 with the diverter assembly 48 to form a portion of the working air path between the wand 14 (and optionally any suction tool 34 coupled to the wand 14) and the collection assembly 20 when the vacuum cleaner 10 is in the canister configuration. One advantage of the design is that the rotary valve body 104 carries the hose duct 108, such that that hose 16 itself may be used to actuate the diverter assembly 48 and smoothly transition between the canister and upright air flow configurations.

The floor inlet duct 96 is coupled with the nozzle coupler 76 on the floor suction nozzle 42 and fluidly communicates the suction inlet 44 with the diverter assembly 48 to form a portion of the working air path between the floor suction nozzle 42 and the collection assembly 20 when the vacuum cleaner 10 is in the upright configuration.

The outlet duct 98 is coupled with an inlet conduit 110 in fluid communication with an inlet of the separating and collection assembly 20 and fluidly communicates the diverter assembly 48 with the separating and collection assembly 20 to form a portion of the working air path between the diverter assembly 48 and the separating and collection assembly 20 when the vacuum cleaner 10 is in either of the upright configuration or the canister configuration.

When the hose duct 108 is rotated forward for the canister mode, as shown in FIG. 7, the working air path is open to the hose inlet port 84 and closed to the floor inlet port 82. The hose duct 108 is positioned on the valve body 104 such that it is in a low, forward position relative to the canister unit 12 in the canister configuration, which provides a low hose pull-point, which is the point at which the vacuum hose 16 exerts a pulling force on the canister unit 12 (see FIG. 4). The low hose pull-point improves the stability of the vacuum cleaner 10 in the canister configuration during operation as the user pulls the canister unit 12 around the surface to be cleaned via the vacuum hose 16.

When the hose duct 108 is rotated rearwardly for the upright mode, as shown in FIG. 8, the working air path is open to the floor inlet port 82 and closed to the hose inlet port 84. The position of the shield 94 coincides with the upright air flow configuration, such that the shield 94 closes the hose inlet port 84 in the upright mode. In the upright configuration, the wand 14 is attached to the wand coupler 64 of the coupling joint 60 (see FIG. 3). In this position, the wand 14 acts as an elongated handle projecting from the housing 52, with the hand grip 40 provided on the proximal end of the wand 14 to facilitate movement of the vacuum cleaner 10 by a user.

Figure 9:
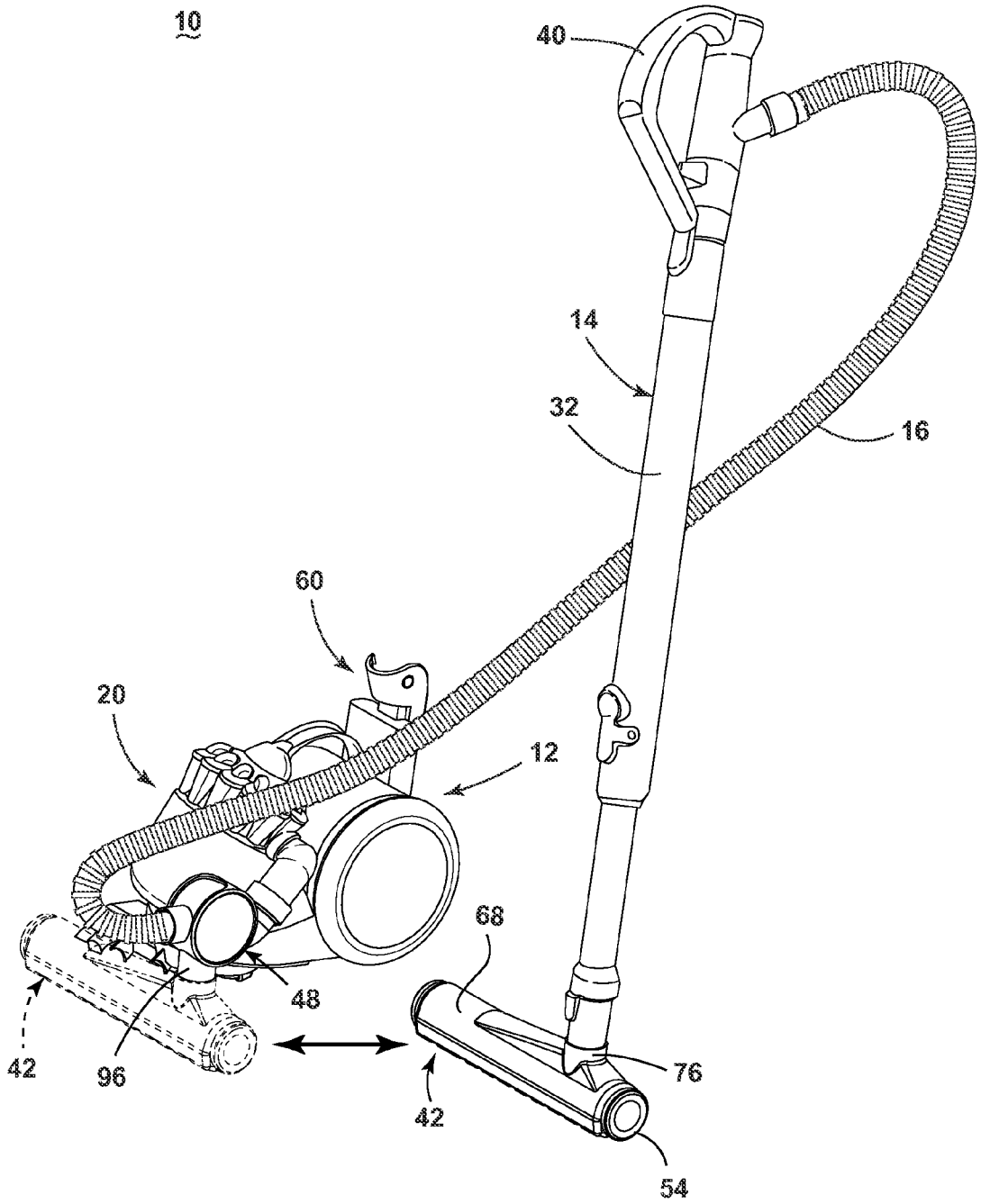
FIG. 9 is a perspective view of a vacuum cleaner according to a third embodiment of the invention, with the vacuum cleaner shown in a canister configuration and having a removable suction nozzle.

FIG. 9 is a perspective view of a vacuum cleaner 10 according to a third embodiment of the invention, with the vacuum cleaner 10 shown in a canister configuration. Like the other embodiments, the vacuum cleaner 10 is convertible between a canister configuration shown in FIG. 9 and an upright configuration. In this embodiment however, the floor suction nozzle 42 is configured as a removable unit which can be selectively detached from the canister unit 12 and attached to the distal end of the wand 14 for use as a tool in the canister configuration. In one example, the suction nozzle 42 can be removable at the nozzle coupler 76, which can be friction fit with either of the wand 14 or the floor inlet duct 96 of the diverter assembly 48. Optionally, as previously described, a movable agitator 46 can be provided within the suction nozzle 42 for agitating debris on the surface to be cleaned so that debris is more easily ingested into the suction inlet 44. A drive system (not shown) for rotating the agitator 46 can be associated with the suction nozzle 42. Some non-limiting examples of agitator drive systems can include a mechanical friction wheel drive system, an air turbine drive system and an electric motor drive system, which are known in the art.

In one example, the wheels 54 can be operably connected to the agitator 46 via a gear train (not shown) and can function as friction drive wheels so that as the wheels roll across the surface to be cleaned, the wheels 54 rotate the agitator 46 via the gear train. Suitable examples of friction wheel drive systems for rotating an agitator assembly are more fully described in U.S. Pat. No. 2,949,624 to Lampe and U.S. Pat. No. 1,268,988 to Mason, which are incorporated herein by reference in their entirety.

In another example, an air-driven turbine fan (not shown) can be coupled to the agitator 46 by a drive belt (not shown). A working air stream can rotate the turbine fan, which, in turn, rotates the agitator 46 via the drive belt operably connected therebetween. A suitable turbine drive system is more fully described in U.S. Patent Application Publication No. 2006/0248680 to Heidenga et al., which is incorporated by reference herein in its entirety.

In yet another example, an electric motor (not shown) can be mounted on the suction nozzle 42 and coupled to the agitator 46 by a drive belt (not shown). Because the suction nozzle 42 can be interchangeably mounted to the canister unit 12 and the end of the wand 14, the electric motor can be configured to draw power from a power source (not shown) provided in either of the suction nozzle 42, the canister 12 and the wand 14, or combinations thereof. For example, a power source (not shown) such as a rechargeable battery can be mounted on the suction nozzle 42 and configured to provide power to the electric motor (not shown). A suitable example of an electric motor drive system powered by a rechargeable battery for driving an agitator mounted in an interchangeable accessory tool is more fully disclosed in U.S. Pat. No. 7,578,025 to Kostreba et al., which is incorporated herein by reference in its entirety. It is further contemplated that the battery can be recharged when the suction nozzle 42 is mounted on the canister 12 via a charging circuit (not shown) and electrical connectors (not shown) that are electrically connected to power source 28 and provided at the junction between the canister 12 and the suction nozzle 42.

During operation, the suction nozzle 42 can be detached from the wand 14 and coupled with the canister unit 12 in the upright configuration, as indicated in phantom line in FIG. 9. Also in the upright configuration, the wand 14 can be attached to the coupling joint 60 as described for the second embodiment, and acts as an elongated handle projecting from the canister unit 12 to facilitate movement of the vacuum cleaner 10 by a user.

The vacuum cleaner disclosed herein includes an improved vacuum cleaner for cleaning a surface. Typically, vacuum cleaners have a single configuration, such as upright or canister. However, the vacuum cleaner disclosed herein is convertible between an upright configuration and a canister configuration, which allows greater usability and flexibility during operation. For example, a user can select the upright configuration when performing certain operations when suited to upright vacuum cleaners, such as cleaning a floor surface, or can easily covert the vacuum cleaner to the canister configuration for other cleaning operations better suited for canister vacuum cleaners, such as cleaning stairs or furniture.

Using the present invention, the user can easily and conveniently convert the air flow path of the vacuum cleaner between the upright and canister configurations. One advantage of the design is that the hose 16 itself may be used to actuate the diverter assembly 48 and smoothly transition between the canister and upright air flow configurations. A user can use their hand to grip the hose 16 or hose duct 108 to move the diverter assembly 48, or may optionally use their foot to nudge the hose 16 or hose duct 108 to the desired orientation. Furthermore, components such as the wand 14 and suction tool can be used in both configurations, thereby doubling the utility of these components.

Another advantage of the present invention is that the length of the working air path of the vacuum cleaner 10 in the upright configuration is relatively short in comparison to conventional upright vacuum cleaners, since the suction nozzle 42, collection assembly 20 and suction source 18 are all provided on the base or canister unit 12, whereas those components are separated by greater distances on a conventional upright vacuum cleaner since they are typically split up, with some components provided on the base and other component provided on the handle assembly. Thus the working air path on a conventional upright vacuum cleaner is generally longer than the working air path of the present invention. The shorter length of the working air path results in less leaks and suction losses, which can contribute to improved cleaning performance and less power consumption. Because the disclosed configuration exhibits less suction losses, a lower power suction source can be utilized while achieving comparable or improved cleaning performance compared to conventional upright or stick vacuum cleaners with longer working air paths and higher power suction sources. The shorter air path and corresponding lower power consumption are advantageous for use in cordless, battery powered applications.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described.

What is claimed is:

1. A vacuum cleaner convertible between an upright mode and a canister mode, the vacuum cleaner comprising:

a canister unit adapted to be moved across a surface to be cleaned;

at least one suction inlet;

a separating and collection assembly for separating and collecting debris;

a suction source in fluid communication with the at least one suction inlet and the separating and collection assembly for generating a working air stream from the at least one suction inlet to the separating and collection assembly;

a conduit defining a working air path and comprising a hose and a wand, wherein the wand is attached to, and forms at least a portion of a handle for, the canister unit in the upright mode and wherein the wand is detached from the canister unit in the canister mode; and a diverter assembly operably coupled with the conduit;

wherein a portion of the conduit is rotatable to move the diverter assembly between an upright configuration in which the working air path of the conduit is closed and a canister configuration in which the working air path of the conduit is open.

2. The vacuum cleaner of claim 1 wherein the at least one suction inlet comprises a floor suction inlet defined by a floor suction nozzle provided on the canister unit and a tool suction inlet defined by a suction tool adapted to be coupled with the conduit in the canister mode.

3. The vacuum cleaner of claim 2 wherein the canister unit carries the suction source, the separating and collection assembly, and the floor suction nozzle.

4. The vacuum cleaner of claim 1 wherein the at least one suction inlet is defined by a suction nozzle configured as a removable unit which can be selectively attached to the canister unit in the upright mode or the conduit in the canister mode.

5. The vacuum cleaner of claim 1 wherein the hose is attached to the canister unit in both the upright mode and the canister mode.

6. The vacuum cleaner of claim 5 wherein the hose is coupled with the diverter assembly in both the upright mode and the canister mode.

7. The vacuum cleaner of claim 1 wherein the wand comprises an elongated hollow tube having a proximal end coupled with the hose and a distal end adapted to receive a suction tool.

8. The vacuum cleaner of claim 7 and further comprising a wand coupler provided on the canister unit adapted to receive the distal end of the tube in the upright configuration.

9. The vacuum cleaner of claim 1 wherein the diverter assembly comprises a first inlet port, a second inlet port, and an outlet port, and a valve selectively closing the first or second inlet port.

10. The vacuum cleaner of claim 9 wherein the diverter assembly comprises a housing defining the first inlet port, the second inlet port, and the outlet port, and the valve comprises a rotary valve body supported by the housing, wherein movement of the valve body within the housing selectively places the first or second inlet port in fluid communication with the outlet port.

11. The vacuum cleaner of claim 9 wherein the hose is coupled to the valve.

12. The vacuum cleaner of claim 11 wherein the valve comprises a hose duct and the hose is coupled to the hose duct.

13. The vacuum cleaner of claim 9 wherein the outlet port is in fluid communication with the separating and collection assembly.

14. The vacuum cleaner of claim 13 wherein the first inlet port comprises a floor inlet port in fluid communication with a floor suction nozzle and the second inlet port comprises a hose inlet port in fluid communication with the hose.

15. The vacuum cleaner of claim 1 wherein the diverter assembly is provided at a lower, forward portion of the canister unit.

16. A vacuum cleaner convertible between an upright mode and a canister mode, the vacuum cleaner comprising:

a canister unit adapted to be moved across a surface to be cleaned and having a separating and collection assembly for separating and collecting debris and a first suction inlet;

a conduit comprising a wand detachably mounted to the canister to form a handle for the canister in the upright mode and a second suction inlet;

a suction source carried by the canister unit; and a diverter assembly operable between a first position, where the first suction inlet is in fluid communication with the suction source in the upright mode, and a second position, where the second suction inlet is in fluid communication with the suction source in the canister mode, wherein the diverter assembly comprises;

a first inlet port fluidly coupled with the first suction inlet;

a second inlet port fluidly coupled with the second suction inlet;

an outlet port;

a valve selectively closing the first or second inlet port;

wherein in the upright mode the wand is mounted to and forms a handle for the canister and the diverter assembly is in the first position, and in the canister mode the wand is detached from the canister unit and the diverter assembly is in the second position; and wherein one end of the conduit is directly physically coupled to the valve of the diverter assembly for movement therewith in both the upright and canister modes.

17. The vacuum cleaner of claim 16 wherein the first suction inlet is defined by a floor suction nozzle provided on the canister unit and the second inlet is defined by the wand.

18. The vacuum cleaner of claim 17 wherein the floor suction nozzle is configured as a removable unit which can be selectively attached to the canister unit in the upright mode or the conduit in the canister mode.

19. The vacuum cleaner of claim 16 wherein the conduit further comprises a hose coupled between the wand and the diverter assembly in both the upright and canister modes, wherein one end of the hose is directly physically coupled to the valve of the diverter assembly for movement therewith in both the upright and canister modes.

20. The vacuum cleaner of claim 19 wherein the wand comprises an elongated hollow tube having a proximal end coupled with the hose and a distal end defining the second suction inlet.

21. The vacuum cleaner of claim 20 and further comprising a wand coupler provided on the canister unit adapted to receive the distal end of the tube in the upright mode.

22. The vacuum cleaner of claim 16 herein the diverter assembly comprises a housing defining the first inlet port, the second inlet port, and the outlet port, and the valve comprises a rotary valve body supported by the housing, wherein movement of the valve body within the housing selectively places the first or second inlet port in fluid communication with the outlet port.

23. The vacuum cleaner of claim 16 wherein the outlet port is in fluid communication with the separating and collection assembly.

24. The vacuum cleaner of claim 16 wherein the diverter assembly is provided at a lower, forward portion of the canister unit.

* * * * *